US012007189B2

(12) United States Patent
Toner et al.

(10) Patent No.: US 12,007,189 B2
(45) Date of Patent: Jun. 11, 2024

(54) HANDGUN SLIDE WITH INTEGRAL COMPENSATOR

(71) Applicant: Sig Sauer, Inc., Newington, NH (US)

(72) Inventors: Sean P. Toner, Merrimack, NH (US); Phillip H. Strader, Stratham, NH (US); Dan M. Hochberg, Epping, NH (US); Luke E. Morenz, Dover, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 18/047,804

(22) Filed: Oct. 19, 2022

(65) Prior Publication Data

US 2024/0011730 A1 Jan. 11, 2024

Related U.S. Application Data

(60) Provisional application No. 63/358,665, filed on Jul. 6, 2022.

(51) Int. Cl.
*F41A 21/36* (2006.01)

(52) U.S. Cl.
CPC ..... *F41A 21/36* (2013.01)

(58) Field of Classification Search
CPC ..... F41A 21/36
USPC ..... 89/14.3
See application file for complete search history.

(56) References Cited

U.S. PATENT DOCUMENTS 5,076,137 A * 12/1991 Paredes ..... F41A 21/36 89/14.3
5,549,030 A * 8/1996 Lespron ..... F41A 21/36 89/14.3
9,995,550 B2 * 6/2018 Shelton ..... F41A 5/02
10,156,412 B1 * 12/2018 Price ..... F41A 21/36
10,222,165 B2 * 3/2019 Niswander ..... F41A 21/36
10,767,952 B1 * 9/2020 Till ..... F41A 21/325
2014/0075800 A1 * 3/2014 Morris, Jr. ..... F41A 21/36 42/1.06
2018/0058792 A1 * 3/2018 Schirmer ..... F41A 21/36
2019/0011209 A1 * 1/2019 Chavez ..... F41A 21/36
2019/0101350 A1 * 4/2019 Hall ..... F41A 21/325
2020/0011630 A1 * 1/2020 Niswander ..... F41A 21/34
2023/0090595 A1 * 3/2023 Underwood ..... F41A 21/36 89/14.3

(Continued)

OTHER PUBLICATIONS

Armory Craft, Armory Craft P365 Comp Slide with RMSc Optics Cut, https://www.armorycraft.com/product-page/armory-craft-p365-comp-slide-with-rmsc-optics-cut (Retrieved May 2022).

(Continued)

*Primary Examiner* — Samir Abdosh

(74) *Attorney, Agent, or Firm* — Finch & Maloney PLLC

(57) ABSTRACT

A slide for a semiautomatic handgun includes a slide body extending along a bore axis and having a top wall, side walls extending downward from lateral margins of the top wall, and a distal end defining a distal opening intersected by the bore axis. The slide body defines an open region between the top wall and the side walls, the open region sized and configured to receive a barrel of the semiautomatic handgun extending along the bore axis and so that a muzzle end of the barrel is spaced axially from the distal end of the slide body. A distal end portion of the top wall defines one or more ports positioned between the distal end of the slide body and the muzzle end of the barrel to be received in the open region.

22 Claims, 5 Drawing Sheets

(56) References Cited

U.S. PATENT DOCUMENTS

| | | | | |
|---|---|---|---|---|
| 2023/0228515 | A1* | 7/2023 | Roe | F41G 1/02 89/14.05 |
| 2023/0266089 | A1* | 8/2023 | Krnezic | F41A 21/325 89/14.3 |

OTHER PUBLICATIONS

Bell, William, PersonalDefenseWorld.com, DE50SRMB: MRI's Desert Eagle Mark XIX Pistol with Integral Muzzle Brake, Personal Defense World, https://www.personaldefenseworld.com/2015/09/de50srmb-mris-desert-eagle-mark-xix-pistol-with-integral-muzzle-brake/ (Sep. 30, 2015).

Glock, Glock Compensated Models, Reduced recoil and increased precision, https://eu.glock.com/en/technology/compensator-pistols (Retreived May 2022).

ZEV Technologies, OZ9C Elite hyper-Comp Pistol, Compact Black Slide, Bronze Barrel, https://www.zevtechnologies.com/OZ9c-Hyper-Comp-Pistol-Compact-Black-Slide-Bronze-Barrel (Retrieved May 2022).

Wise Lite Arms, The P.E.W.—Port Enhanced Weapon System For Glock Slide Compensation and Barrel Porting, https://www.wlarms.com/Port-Enhanced-Weapon-System-p/pew098.htm (Retreived May 2022).

Trinity Nevada, Ground Breaker Complete Slide, https://trinitynevada.com/products/compensated/ground-breaker-complete-slide/ (Retreived May 2022).

Honest Outlaw, Trinity Nevada Ground Zero 1000 Round Review, https://www.youtube.com/watch?v=i_P1oolWcll (Oct. 25, 2020).

* cited by examiner

HANDGUN SLIDE WITH INTEGRAL COMPENSATOR

RELATED APPLICATIONS

This application claims the benefit under 35 U.S.C. § 119(e) of U.S. Provisional Patent Application No. 63/358,665 titled HANDGUN SLIDE WITH INTEGRAL COMPENSATOR, and filed on Jul. 6, 2022, the contents of which are incorporated herein by reference in its entirety

FIELD OF THE DISCLOSURE

The present disclosure relates generally to handguns and more specifically to a handgun slide with an integral compensator.

BACKGROUND

A muzzle brake or recoil compensator is a type of muzzle device for a firearm that is designed to reduce muzzle rise or "muzzle flip" by redirecting a portion of propellant gases leaving the barrel. Some compensators can be attached to the barrel, such as threading the device onto a threaded handgun barrel or rifle barrel. Other compensators are integral to the barrel, such as when the barrel defines ports along the length of the barrel to vent gases through corresponding openings in the barrel. Whether using an attachment or using ports in the barrel, the burst of propellant gases is typically directed upward to counter recoil forces that tend to cause muzzle rise upon firing the gun. A recoil compensator or simply "compensator" may be used on a handgun with the advantage of enabling the shooter to more quickly realign sights on a target for the next shot.

SUMMARY

One aspect of the present disclosure is directed to a slide for a semiautomatic handgun, where a distal end portion of the slide defines an integral compensator. In one such embodiment, the distal end portion of the slide defines one or more ports in the top of the slide, the port(s) oriented to vent a portion of gases in an upward direction after leaving the barrel. This distal end portion of the slide located distally of the end of the barrel may be referred to as the compensator portion. In one example, the compensator portion of the slide defines two ports that are spaced axially, where each port is generally oriented crosswise to the slide. The port(s) can have any of a variety of shapes, including a crosswise slot, a chevron shape, an arc, or some other shape. One or more of the ports can be spaced from the end of the barrel so as to define a direct line of sight within a cone of not more than 90 degrees from the barrel to the port, for example. As combustion gases exit the barrel, a portion of gases can impinge on rearward-facing surfaces defining the port(s), resulting in a delay of the slide's rearward travel and/or a speed reduction in the slide's rearward travel after firing the gun.

A slide with integral compensator can be a stand-alone component, such as a replacement part for an existing handgun. The slide can also be part of a recoil assembly for a semiautomatic handgun or provided as part of a complete handgun. For example, the recoil assembly can be part of a new handgun or can be a retrofit kit to update an existing handgun. In one embodiment, the recoil assembly includes a slide, a barrel, a recoil spring, and a recoil spring guide. In one such embodiment, the spring guide and recoil spring are longer than the corresponding parts used in a slide that terminates at the end of the barrel. For example, due to the integral compensator, the bottom of the slide includes a spring box at distal end portion of the slide. This spring box accepts an end of the recoil spring and guide rod. Due to the increased length of the slide compared to the barrel length, the slide can accommodate a longer recoil spring guide and recoil spring compared to an assembly of equivalent length of slide and a traditional compensator that is threaded onto the barrel. Advantageously, the increased recoil spring length can provide improved spring efficiency and reduced stress on the recoil spring.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

The figures depict various embodiments of the present disclosure for purposes of illustration only. Numerous variations, configurations, and other embodiments will be apparent from the following detailed discussion.

DETAILED DESCRIPTION

Disclosed is a slide for a semiautomatic handgun, a distal end portion of the slide defining an integral compensator. In one such embodiment, a distal end portion of the slide defines one or more ports through the top surface, where the ports are located distally of the end of the barrel when assembled. The port(s) are positioned to vent a portion of muzzle gases in an upward direction from the barrel to reduce muzzle rise upon firing a shot. In some embodiments, each compensator port has faces that are oriented perpendicularly to the bore axis, such as rearward or forward-facing faces that are vertical with respect to a horizontal bore axis). In addition to gases exiting upward through each port, muzzle gases impinge on the rearward-facing surfaces that define the port(s). The gases impinging on these surfaces provides a force in a distal direction that may result in a delay and/or reduced velocity of the slide's rearward travel after firing the gun.

The bottom of the slide includes a spring box configured to accept an end portion of the recoil spring and recoil spring guide. At least part of the spring box is located forward of the end of the barrel, enabling the slide to accommodate a recoil spring guide and recoil spring of increased length compared to a slide without the compensator portion.

Overview

Existing handgun compensators can be attached to the end of the barrel, such as by threaded engagement. An add-on compensator increases the length and mass of the barrel. The add-on compensator may also require properly timing the compensator to the barrel, loosening of the threaded engagement during use as a result of thermal cycles, and other challenges. Another approach is for the barrel to define gas ports along its length and for the slide to define corresponding openings to vent gases from the barrel's gas ports. Such an approach increases the cost and complexity of the barrel. Such an approach may also result in a reduced barrel life due to erosion of the barrel at these ports. Further, some handgun compensators also require significant additional energy to cycle the action due the added mass. As a result, the gun may fail to cycle completely, resulting in a malfunction. Despite existing approaches to compensators for a handgun, many non-trivial challenges remain. Accordingly, the present disclosure provides a handgun slide with an integral compensator.

Example Embodiments

Figure 1:
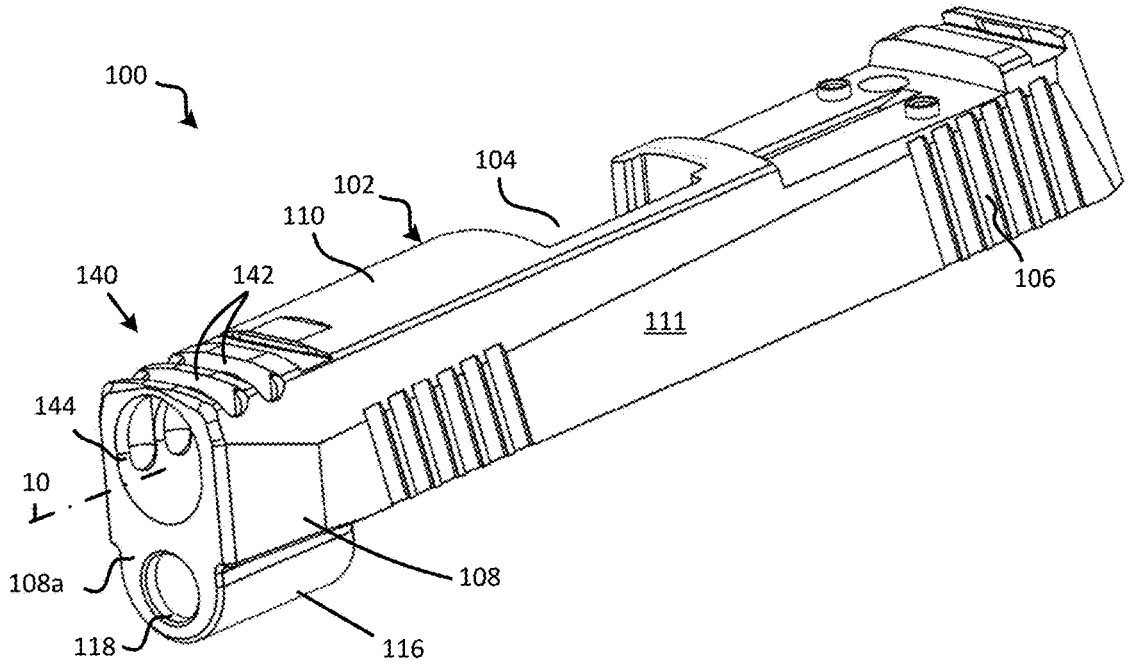
FIG. 1 illustrates a front perspective view of a slide with integral compensator, in accordance with an embodiment of the present disclosure.
Figure 2:
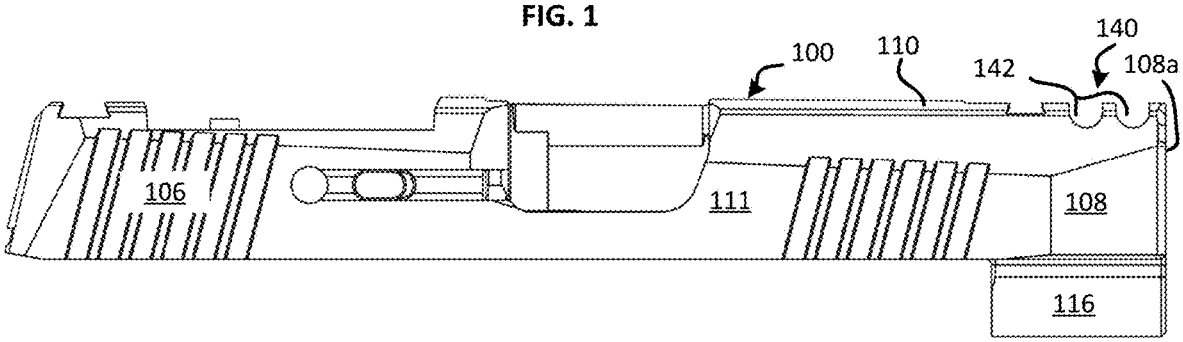
FIG. 2 illustrates a side view of the slide of FIG. 1.

FIG. 1 illustrates a front perspective view of a handgun slide 100 with an integral compensator 140, in accordance with an embodiment of the present disclosure. FIG. 2 shows a side view of the slide of FIG. 1.

Figure 8:
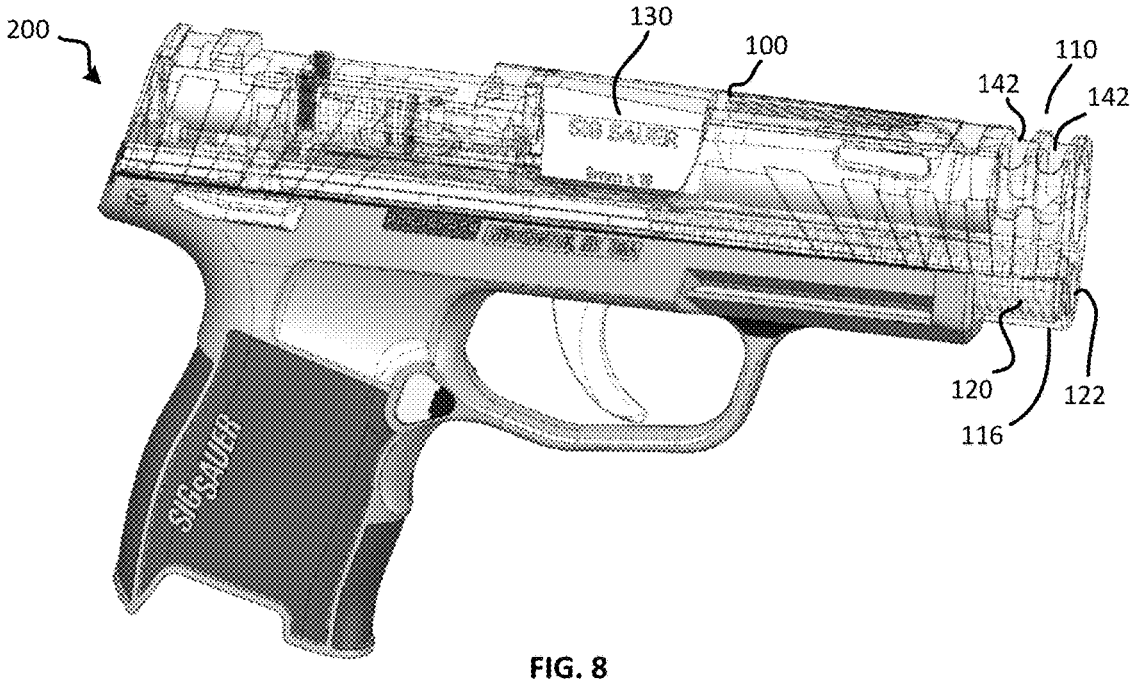
FIG. 8 illustrates a handgun that includes a slide with integral compensator, in accordance with an embodiment of the present disclosure.
Figure 9:
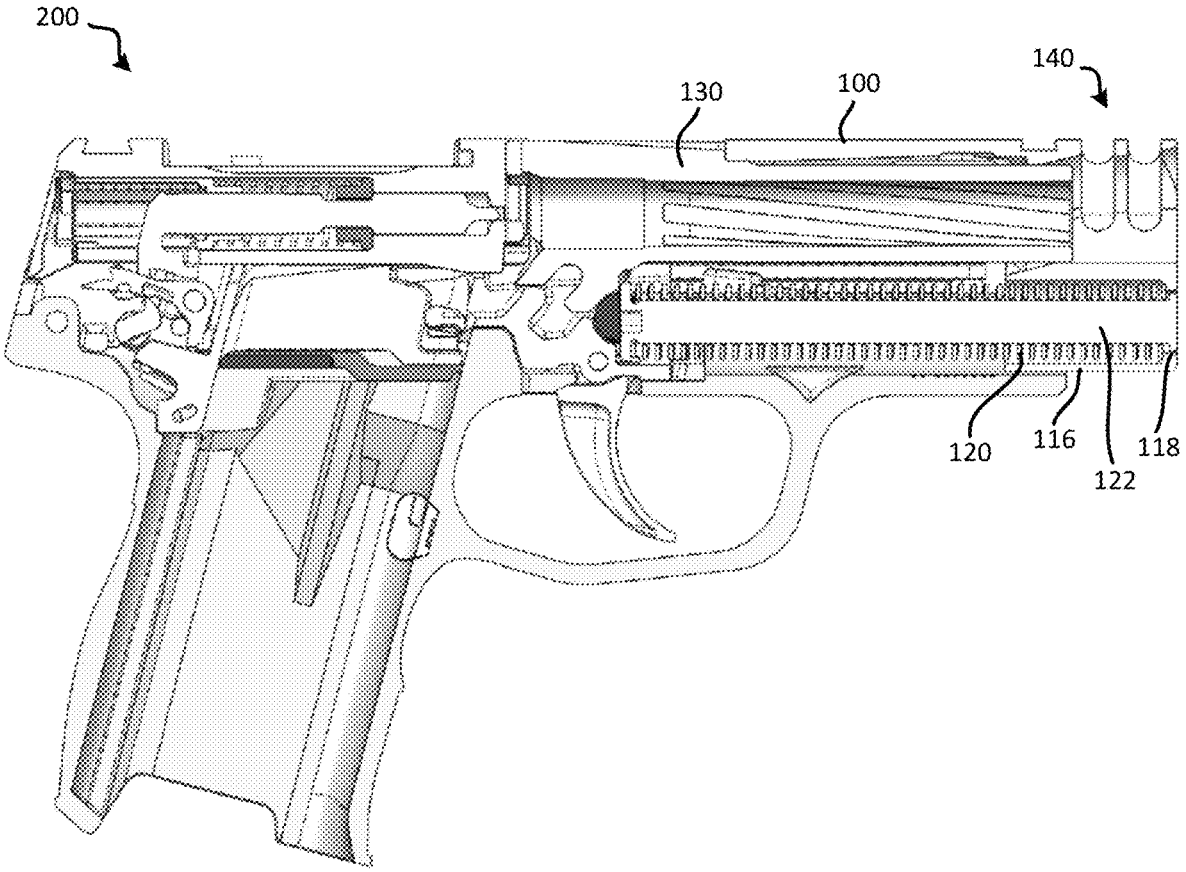
FIG. 9 is a cross-sectional side view of the handgun of FIG. 8.

The slide 100 has a slide body 102 that extends longitudinally along a bore axis 10 and includes a top wall 110 and sidewalls 111 extending downward from the top wall 110. The slide 100 is configured to reciprocate along a frame of a semiautomatic handgun 200, such as shown in FIGS. 8-9. The slide 100 defines an ejection port 104, a proximal end portion 106, and a distal end portion 108 with a distal end 108*a* or distal wall 108*a*. The distal end portion 108 of the slide 100 defines a compensator 140. In some embodiments, the slide 100 includes a spring box 116 along the bottom of the slide body 102. The spring box 116 can be configured to receive part of a recoil spring guide 122 and recoil spring 120 (shown in FIG. 8) in a recoil guide opening 118. In some embodiments, at least a portion of the spring box 116 (e.g., a majority portion) is positioned distally of a distal end 132 of the barrel 130 when assembled. In other embodiments, the spring box 116 can have a near-zero length or is sized such that the spring box 116 is reduced to a plate having an axial thickness of the distal end 108*a* of the slide body 100. For example, the distal wall 108*a* extends downward from the slide body 102 and defines a recoil guide opening 118.

The compensator 140 is part of the slide 100 and includes one or more ports 142 defined through the top wall 110 of the slide 100, where the port(s) 142 are located between the distal end 132 of the barrel 130 and the distal end 108*a* of the slide 100. During use, each port 142 is configured to vent a portion of combustion gases exiting the muzzle end of the barrel 130 in an upward direction to counter recoil forces that tend to cause muzzle rise upon firing. Even though some combustion gases vent through port(s) 142, a majority portion of combustion gases travel along the bore axis 10 and through the distal opening 144 at the distal end 108*a* of the slide 100. In this example, the compensator 140 includes two ports 142. In other embodiments, the compensator 140 can have a single port 142 or more than two ports 142.

Each port 142 can be configured as a lateral or crosswise slot that extends vertically through an upper portion of the slide 100. Each port 142 is machined or otherwise formed in the slide to result in vertical front and rear surfaces of the port 142 when the central axis is oriented horizontally. Stated differently, the surfaces defining each port 142 are perpendicular or substantially perpendicular (e.g., vertical ±2°) to the bore axis 10 (e.g., horizontal). In some embodiments, the surfaces of a port 142 can be inclined to the bore axis 10 so as to define a port 142 that increases in volume moving upward through the port 142 from the inside of the slide 100. For example, one or more of the ports can have a trapezoidal geometry. In other embodiments, the port(s) 142 can have other geometries as viewed from above, including an arcuate shape, chevron shape, a single opening of round or other geometric shape, a group of openings, axially-oriented slots, or a combination of openings of different shapes. Numerous variations and embodiments will be apparent in light of the present disclosure.

Figure 3:
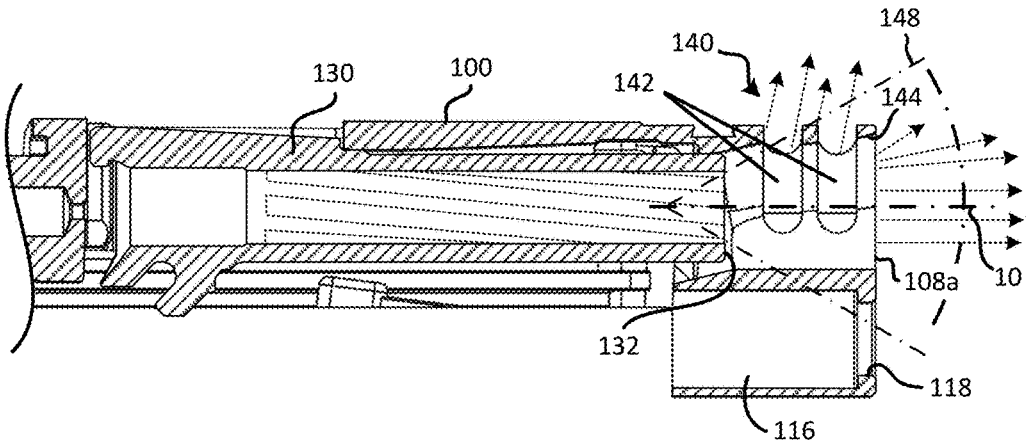
FIG. 3 illustrates a cross-sectional view of part of a slide and barrel, in accordance with an embodiment of the present disclosure.

FIG. 3 illustrates a cross-sectional view of part of a slide 100 and a barrel 130, in accordance with an embodiment of the present disclosure. The muzzle end or distal end 132 of the barrel 130 is within the slide 100 and is spaced axially from the distal end 108*a* of the slide 100 by the compensator 140. The ports 142 are between the distal end 132 of the barrel 130 and the distal end 108*a* of the slide 100 when assembled. Arrows in FIG. 3 illustrate an example of flow paths of combustion gases upon firing. In this example, a majority portion of gases continue to travel along the bore axis 10 as the gases exit the slide 100 through the distal opening 144 during at least a portion of the firing cycle. A minority portion of gases exits through ports 142 in an upward direction. The gases exiting through ports 142 may travel primarily at an angle between to the bore axis 10, in some embodiments. Some of gases exiting through an upper part of the distal opening 144 travel at a shallow upward angle (e.g., from 5° to 30°). Without being constrained to any particular theory, it is believed that gases venting through ports 142 reduces the pressure in the upper region of the distal opening 144 and causes an upward flow path as gases expand into this region of reduced pressure. It is to be appreciated that expanding combustion gases may travel in other directions after exiting the slide 100 during at least some portion of the firing cycle. Note that gas flow volumes and velocities may change throughout the firing cycle and the example gas flows shown and discussed may not be representative of the entire firing cycle.

In this example the distal-most port 142 is within a cone 148 extending in front of the barrel opening and tangential to the barrel opening. As shown, the cone 148 has an angle between sides of the cone of 60°; other values are acceptable, including a cone of not more than 70°, not more than 80°, or not more than 90° in some embodiments. In some such embodiments, a greater portion of gases vent through the distal-most port 142 compared to the proximal-most port 142 due to the distal-most port 142 having a direct line-of-sight to the barrel 130.

Figure 4:
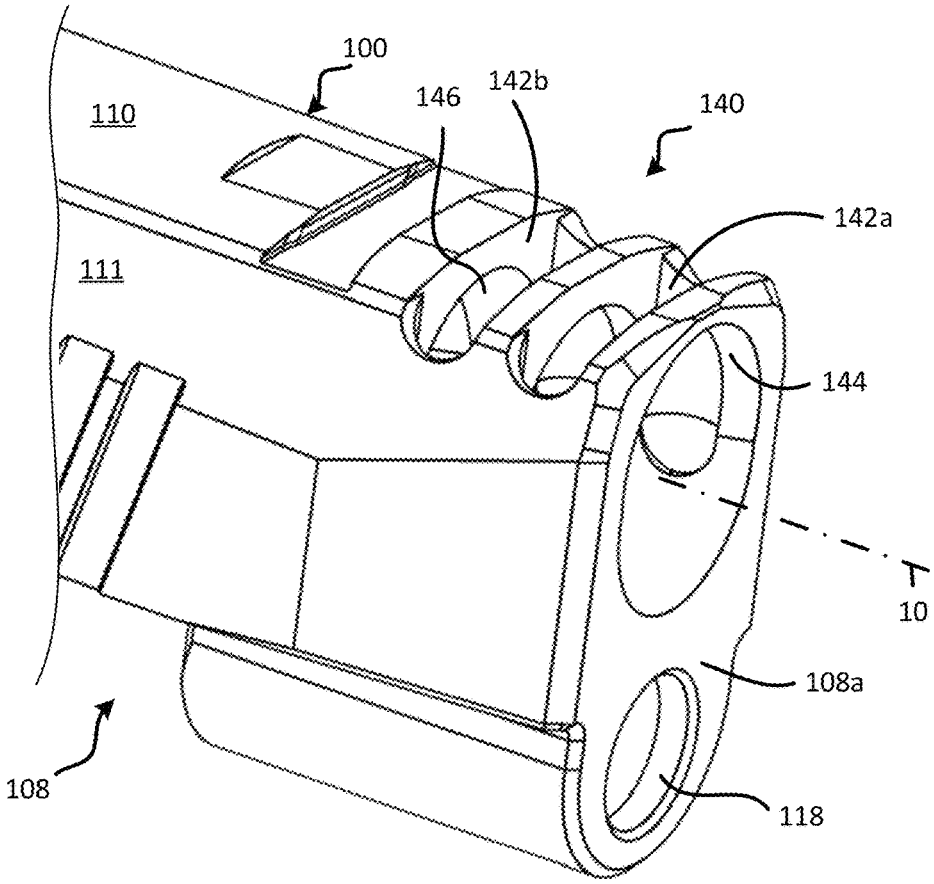
FIG. 4 illustrates a side perspective view of a distal end portion of a slide, showing the compensator portion, in accordance with an embodiment of the present disclosure.
Figure 5:
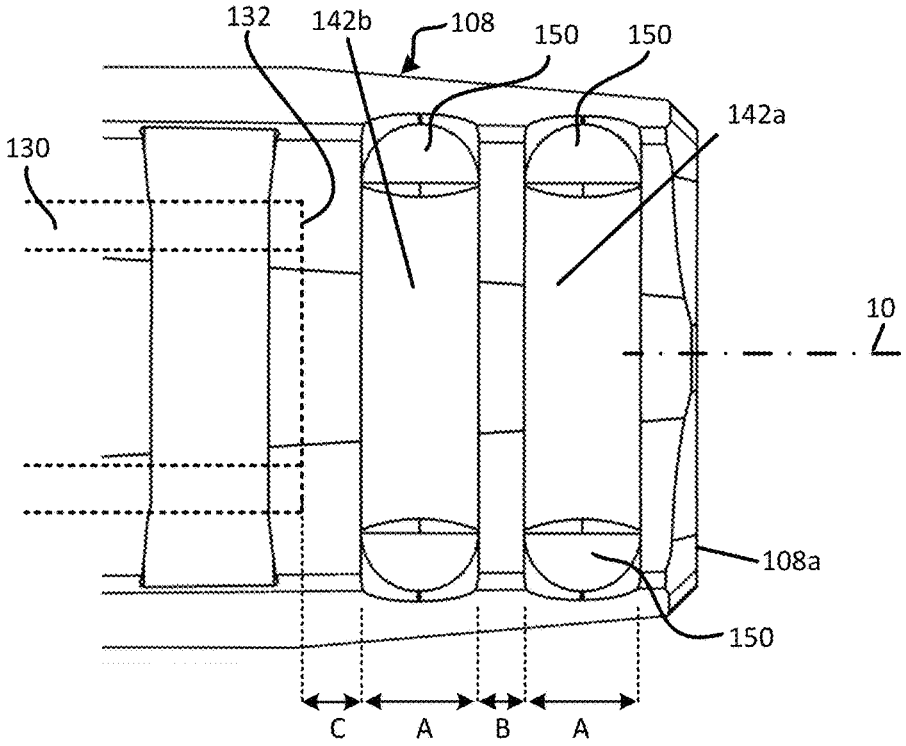
FIG. 5 illustrates a top view of the distal end portion of the slide of FIG. 4.

FIG. 4 illustrates a perspective view of a distal end portion 108 of a slide 100, and FIG. 5 illustrates a top view of the distal end portion 108, in accordance with an embodiment of the present disclosure. The distal end portion 108 defines a compensator 140 that includes two ports 142 through the top of the slide 100. The ports 142 include a distal port 142*a* and a proximal port 142*b*. As can be partially seen through the proximal port 142*b* of FIG. 4, the slide 100 defines a barrel opening 146 spaced axially from the distal opening 144 at the distal end 108*a* of the slide 108. In some embodiments, the barrel opening 146 is smaller than the distal opening 144. The barrel opening 146 and distal opening 144 are shown as being circular in this example, but the slide 100 is not restricted to these shapes. For example, the distal opening 144 can be ovoid or some other shape having a greater size in an upper portion of the opening 144. In some embodiments, a center of the distal opening 144 is offset vertically with respect to the bore axis 10.

In some embodiments, the proximal port 142*a* is spaced from the end 132 of the barrel 130 by a distance C from 1-5 mm, each port 142 has an axial dimension A of 3-7 mm, and ports 142 are spaced axially by a distance B from 1.0-2.0 mm. In one embodiment, each port 142 has an axial dimension A of about 5 mm and the ports 142 are spaced axially by distance B of about 1.8 mm. In one embodiment, the proximal port 142*b* is spaced by a distance C of 2-3 mm, such as about 2.5 mm from the distal end 132 of the barrel 130. Note also that ports 142 extend laterally into the inside wall slide 100 beyond the width of the barrel 130, defining pockets 150 along lateral insides surfaces of the distal end portion 108. The increased volume within the distal end portion 108, including pockets 150, distal opening 144, and ports 142 may reduce flash in some embodiments.

Figure 6:
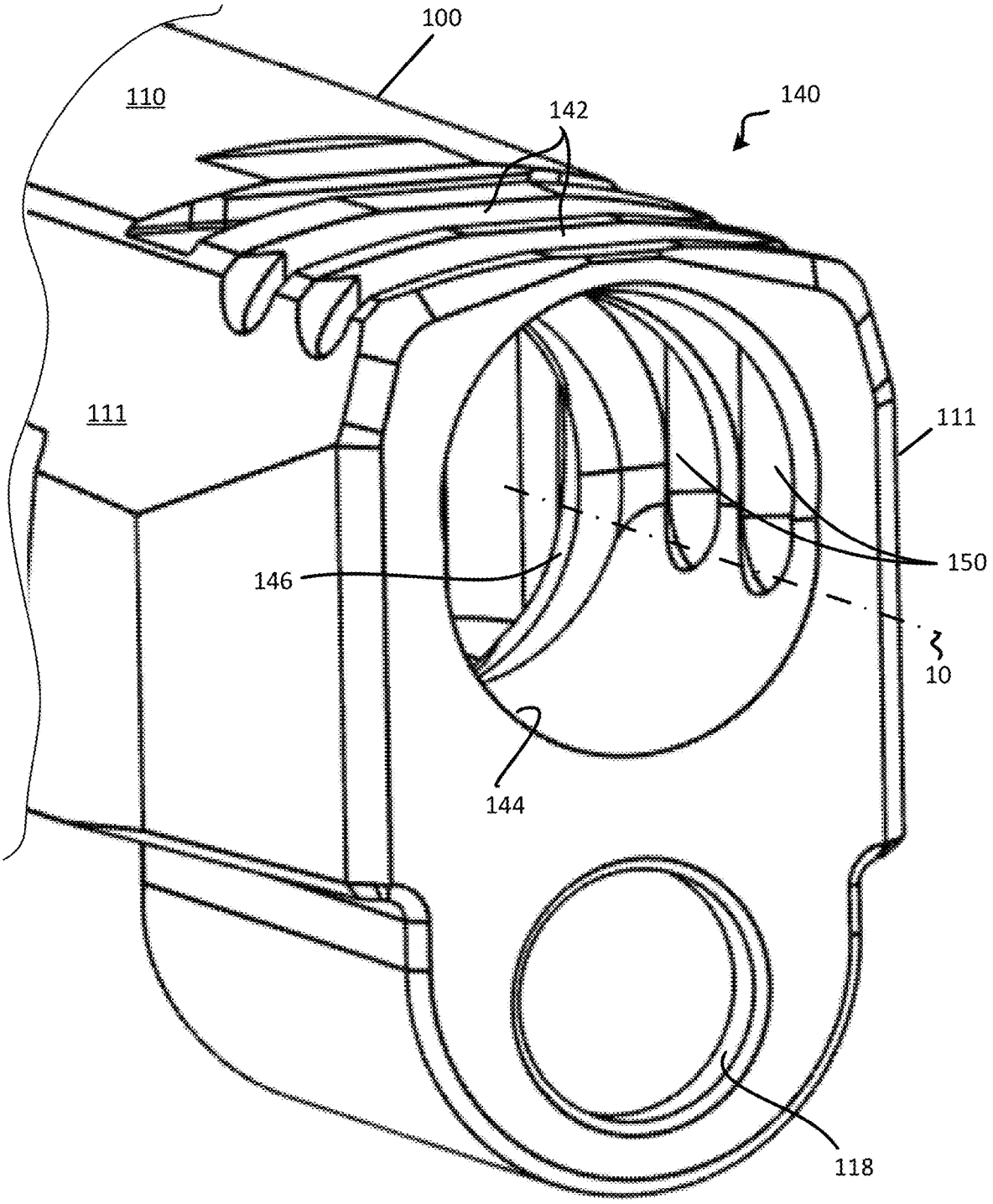
FIG. 6 is a front perspective view of the compensator portion of FIG. 4.

FIG. 6 illustrates a perspective view of the distal end portion 108 of a slide 100, in accordance with an embodiment. In this example, pockets 150 can be seen in the inside wall of the distal end portion 108. Ports 142 through the top wall 110 of the slide 100 can also be seen. Pockets 150 extend laterally into the sidewalls 111 of the slide 100 laterally beyond the distal opening 144 and laterally beyond the barrel opening 146. Stated differently, the pockets 150 have a lateral width that is greater than a diameter of the barrel opening 146. In this example, the bottom of each pocket 150 is approximately aligned with the bore axis 10 and extends upward along the inside of each sidewall 111.

Figure 7:
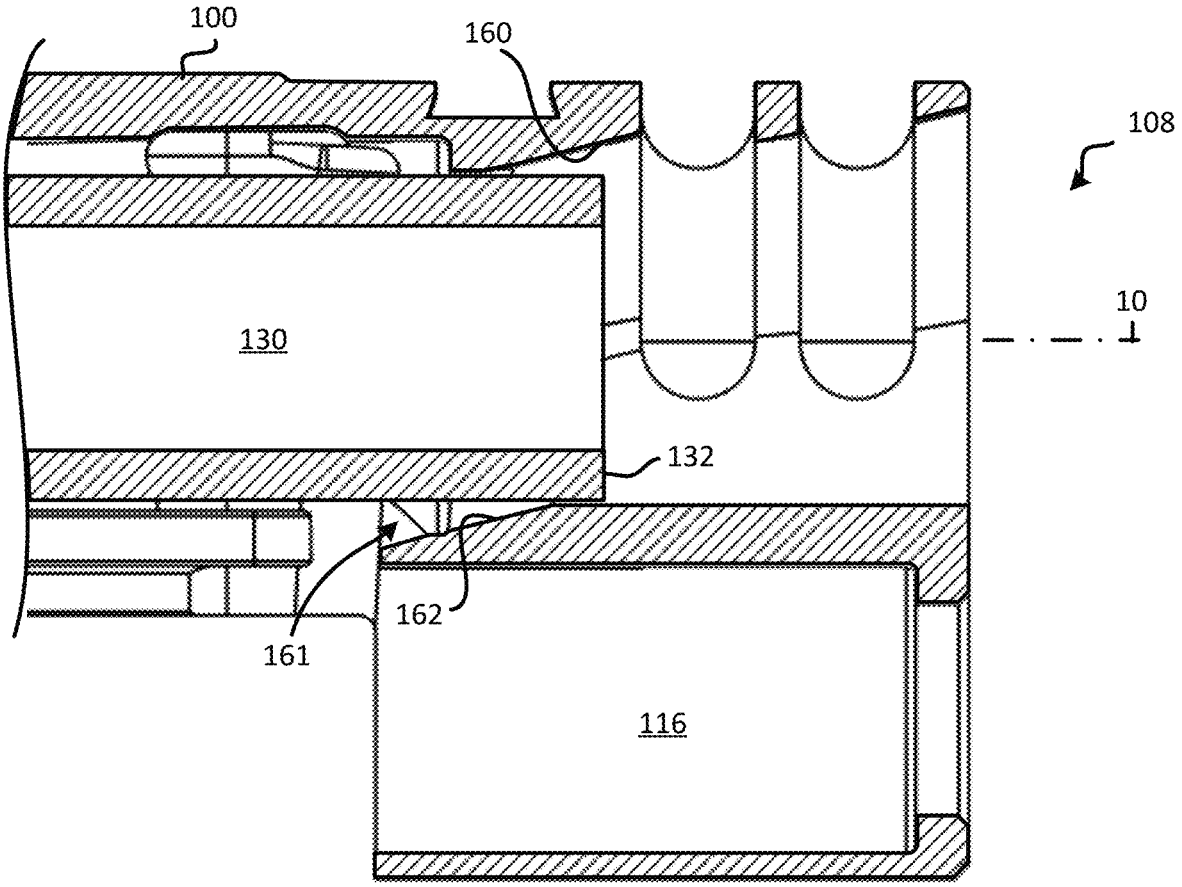
FIG. 7 is a cross-sectional view of a distal end portion of a slide and barrel, in accordance with an embodiment of the present disclosure.

FIG. 7 illustrates a cross-sectional view of a distal end portion 108 of a slide 100 and a barrel 130 within the slide 100, in accordance with an embodiment of the present disclosure. The inside of the slide 100 defines barrel passageway 161 between an upwardly inclined top surface 160 and an upwardly inclined bottom surface 162 in the inside of the distal end portion of the slide 100. The barrel passageway 161 is configured to receive the distal end portion of the barrel 103 when it is inclined during installation and when it extends along the bore axis 10 after installation. Due to the extended length of the slide 100 relative to the barrel 130, the barrel passageway 161 facilitates installation of the barrel 130 in the slide 100 by enabling an inclined orientation of the barrel 130 during installation. For example, the user may insert the distal end 132 of the barrel 130 into the barrel passageway 161 at an angle transverse to the slide 100, then tip the proximal end or chamber of the barrel 130 into place so that the barrel 130 is parallel to the slide 100. In one embodiment, the inclined top and bottom surfaces 160, 162 defining the barrel passageway 161 are inclined to the bore axis 10 at an angle of 10-20 degrees, such as about 15 degrees. These surfaces 160, 162 can be parallel in some embodiments.

FIG. 8 illustrates a perspective view of a handgun 200 with a slide 100 that includes an integral compensator 140, in accordance with an embodiment of the present disclosure. FIG. 9 is a side, cross-sectional view of the handgun 200 of FIG. 8. The slide 100 is shown as transparent in FIG. 8. In these examples, the slide 100 extends beyond the distal end 132 of the barrel 130 so that the ports 142 of the compensator 140 are positioned distally of the barrel 130. The recoil spring 120 is installed on the recoil spring guide 122, which extends distally beyond the barrel and is received in the recoil guide opening 118 of the spring box 116.

Further Example Embodiments

The following examples pertain to further embodiments, from which numerous permutations and configurations will be apparent.

Example 1 is a slide for a semiautomatic handgun, the slide including an integral compensator. In one embodiment, the slide has a top portion extending along a central axis, side portions connected to the top portion and depending downward. A proximal end is connected to the top portion and side portions. A distal end is connected to the top portion and side portions, the distal end defining a distal opening. The slide defines an open region between the side portions and the top portion, where the open region is configured to receive a barrel of the semiautomatic handgun. A distal end portion of the slide defines one or more ports in the top portion, the one or more ports positioned between the distal end of the slide and a distal end of the barrel to be received in the open region. The one or more ports are configured to vent a portion of gases exiting the barrel upon firing the handgun.

Example 2 includes the slide of Example 1, wherein each of the one or more ports is defined in part by a proximally facing face of the slide, the proximally facing face being oriented perpendicularly to the central axis.

Example 3 includes the slide of Examples 1 or 2, wherein at least one of the one or more ports include a line of sight to the barrel, the line of sight within a cone with a cone angle of 90° or less.

Example 4 includes the slide of Example 3, wherein the cone angle is 80° or less.

Example 5 includes the slide of Example 3, wherein the cone angle is 70° or less.

Example 6 includes the slide of Example 3, wherein the cone angle is 60° or less.

Example 7 includes the slide of any one of Examples 1-6 and further comprises a spring box on a bottom of the slide adjacent the distal end, where at least a majority portion of the spring box is positioned distally of the distal end of the barrel to be received in the open region.

Example 8 includes the slide of any one of Examples 1-7, where the open region includes inclined top and bottom surfaces adjacent the distal end of the barrel to be received in the open region, the inclined top and bottom surfaces defining a barrel passageway in the distal end portion of the slide, where the barrel passageway is inclined at an angle from 5-30 degrees with respect to the central axis.

Example 9 includes the slide of Example 8, where the angle is from 10-20 degrees.

Example 10 includes the slide of Example 8, where the angle is about 15 degrees.

Example 11 includes the slide of any one of Examples 1-10, where the slide is configured to extend at least 15 mm beyond the distal end of the barrel.

Example 12 includes the slide of any one of Examples 1-11, where the slide defines a barrel opening in the distal end portion, the barrel opening having a size that is smaller than the distal opening.

Example 13 includes the slide of any one of Examples 1-12, where the distal opening has a non-circular shape.

Example 14 includes the slide of Example 13, where the distal opening has an ovoid shape.

Example 15 includes the slide of Example 1-14, where a majority area of the distal opening is above a bore axis of the barrel.

Example 16 is a slide for a semiautomatic handgun, the slide including a slide body extending along a bore axis and having a top wall, side walls extending downward from lateral margins of the top wall, and a distal end defining a distal opening intersected by the bore axis. The slide body further defines a recoil guide opening vertically below the distal opening. The slide body defines an open region between the top wall and the side walls, the open region sized and configured to receive a barrel of the semiautomatic handgun extending along the bore axis and so that a muzzle end of the barrel is spaced axially from the distal end of the slide body. A distal end portion of the top wall defines one or more ports positioned between the distal end of the slide body and the muzzle end of the barrel to be received in the open region.

Example 17 includes the slide of Example 16 and includes a spring box extending rearwardly along a bottom of the slide body from the distal end, at least part of the spring box being positioned distally of the muzzle end of the barrel when the barrel is installed in the open region.

Example 18 includes the slide of Example 16 or 17, where the slide body defines a barrel opening spaced axially from the distal opening and having a size that is smaller than the distal opening.

Example 19 includes the slide of any one of Example 16-18, where an inside of the slide body includes an inclined top surface and an inclined bottom surface defining the barrel opening therebetween, the inclined top and bottom surfaces inclined at an angle from 5 to 30 degrees with respect to the bore axis and defining a barrel passageway.

Example 20 is a recoil assembly comprising the slide of any one of Examples 1-19, a barrel sized and configured to be received in the open region of the slide, a recoil spring, and a recoil spring guide. The recoil spring and the recoil spring guide are sized to extend beyond the distal end of the barrel.

Example 21 includes the subject matter of Example 20, where the barrel has a barrel length from 3 to 5 inches.

Example 22 includes the subject matter of Example 21, where the barrel has a barrel length from 3.0 to 3.5 inches.

Example 23 includes the subject matter of Example 21, where the barrel has a barrel length from 3.0 to 3.25 inches.

Example 24 includes the subject matter of any one of Examples 20-23, where the barrel is chambered for 9 mm Luger ammunition.

Example 25 includes the subject matter of any one of Examples 20-23, where the barrel is chambered for 0.380 ACP ammunition.

Example 26 includes the subject matter of any one of Examples 20-23, where the barrel is chambered for 0.45 AUTO ammunition.

Example 26 is a semiautomatic handgun comprising the recoil assembly of any one of Examples 20-26.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A slide for a semiautomatic handgun, the slide comprising:

a top portion extending along a central axis;

side portions connected to and extending downward from the top portion;

a distal end connected to the top portion and side portions, the distal end defining a distal opening;

wherein the slide defines an open region between the side portions and the top portion, the open region sized and configured to receive a barrel of the semiautomatic handgun so that a muzzle end of the barrel is spaced axially from the distal end of the slide;

wherein the open region includes inclined top and bottom surfaces adjacent the muzzle end of the barrel to be received in the open region, the inclined top and bottom surfaces defining a barrel passageway in the distal end portion of the slide, wherein the barrel passageway is inclined at an angle from 5 to 30 degrees with respect to the central axis; and wherein a distal end portion of the slide defines one or more ports in the top portion, the one or more ports positioned between the distal end of the slide and the muzzle end of the barrel to be received in the open region, the one or more ports configured to vent a portion of gases exiting the barrel upon firing the handgun.

2. The slide of claim 1, wherein each of the one or more ports is defined in part by a proximally facing face of the top portion of the slide, wherein the proximally facing face extends perpendicularly to the central axis.

3. The slide of claim 1, wherein at least one of the one or more ports include a line of sight to the barrel, the line of sight within a cone with a cone angle of 75° or less.

4. The slide of claim 3, wherein the cone angle is 60° or less.

5. The slide of claim 1, further comprising a spring box on a bottom of the slide adjacent the distal end, at least a portion of the spring box is positioned distally of the muzzle end of the barrel to be received in the open region.

6. The slide of claim 5, wherein a majority portion of the spring box is positioned distally of the muzzle end of the barrel.

7. The slide of claim 1, wherein the angle is from 10-20 degrees.

8. The slide of claim 1, wherein the distal end of the slide is at least 15 mm beyond the muzzle end of the barrel when the barrel is installed in the open region.

9. The slide of claim 1, wherein the slide defines a barrel opening in the distal end portion, the barrel opening axially spaced from the distal opening and having a size that is smaller than the distal opening.

10. The slide of claim 9, wherein the distal opening has a non-circular shape.

11. The slide of claim 10, wherein a center of the distal opening is vertically offset with respect to a bore axis through a center of the barrel opening.

12. A slide for a semiautomatic handgun, the slide comprising:

a slide body extending along a bore axis and having a top wall, side walls extending downward from the top wall, and a distal end defining a distal opening intersected by the bore axis, the slide body further defining a recoil guide opening vertically below the distal opening;

wherein the slide body defines an open region between the top wall and the side walls, the open region sized and configured to receive a barrel of the semiautomatic handgun extending along the bore axis and so that a muzzle end of the barrel is spaced axially from the distal end of the slide body; and wherein a distal end portion of the top wall defines one or more ports positioned between the distal end of the slide body and the muzzle end of the barrel to be received in the open region.

13. The slide of claim 12, further comprising a spring box extending rearwardly along a bottom of the slide body from the distal end, the spring box defining the recoil guide opening, wherein at least part of the spring box is positioned distally of the muzzle end of the barrel when the barrel is installed in the open region.

14. The slide of claim 12, wherein the slide body defines a barrel opening spaced axially from the distal opening, the barrel opening having a size that is smaller than the distal opening.

15. The slide of claim 14, wherein an inside of the slide body includes an inclined top surface and an inclined bottom surface defining the barrel opening therebetween, the inclined top and bottom surfaces inclined at an angle from 5 to 30 degrees with respect to the bore axis and defining a barrel passageway.

16. A recoil assembly comprising:

the slide of claim 15;

a barrel sized and configured to be received in the open region of the slide;

a recoil spring guide having an end portion configured to be received in the recoil guide opening;

a recoil spring configured to be installed on the recoil spring guide.

17. The recoil assembly of claim 16, wherein the barrel has a barrel length from 3.0 to 3.5 inches.

18. The recoil assembly of claim 16, wherein the barrel has a barrel length from 2.75 to 3.25 inches.

19. A semiautomatic handgun comprising the recoil assembly of claim 16.

20. A slide for a semiautomatic handgun, the slide comprising:

a top portion extending along a central axis;

side portions connected to and extending downward from the top portion; and a distal end connected to the top portion and side portions, the distal end defining a distal opening;

wherein the slide defines an open region between the side portions and the top portion, the open region sized and configured to receive a barrel of the semiautomatic handgun so that a muzzle end of the barrel is spaced axially from the distal end of the slide;

wherein a distal end portion of the slide defines one or more ports in the top portion, the one or more ports positioned between the distal end of the slide and the muzzle end of the barrel to be received in the open region, the one or more ports configured to vent a portion of gases exiting the barrel upon firing the handgun; and wherein at least one of the one or more ports has a line of sight to the barrel, the line of sight within a cone with a cone angle of 75° or less.

21. The slide of claim 20, wherein the one or more ports are configured and arranged to reduce muzzle flip by venting combustion gases in an upward direction upon firing.

22. The slide of claim 12, wherein the one or more ports are configured and arranged to reduce muzzle flip by venting combustion gases in an upward direction upon firing.

* * * * *